US005398339A

United States Patent [19]

Wagner

[11] Patent Number: 5,398,339

[45] Date of Patent: Mar. 21, 1995

[54] SHOULDER PAD ASSEMBLY FOR CONTACT SPORTS

[75] Inventor: Stephen G. Wagner, Kitchener, Canada

[73] Assignee: Canstar Sports Group Inc., Ville Mont-Royal, Canada

[21] Appl. No.: 159,324

[22] Filed: Nov. 30, 1993

[30] Foreign Application Priority Data

Dec. 3, 1992 [CA] Canada ..... 2084438

[51] Int. Cl.[6] ..... A41D 13/00; A61F 5/02

[52] U.S. Cl. ..... 2/2; 2/45; 2/268

[58] Field of Search ..... 2/2, 44, 45, 267, 268; 602/16, 19

[56] References Cited

U.S. PATENT DOCUMENTS

| | | | |
|---|---|---|---|
| 1,887,473 | 11/1932 | Warner | 2/2 |
| 3,740,763 | 6/1973 | Mitchell | 2/2 |
| 4,516,273 | 5/1985 | Gregory et al. | 2/2 |
| 4,590,621 | 5/1986 | Flosi et al. | 2/2 |
| 4,868,925 | 9/1989 | Mitchell | 2/2 |
| 4,872,216 | 10/1989 | Wingo, Jr. | 2/45 |

*Primary Examiner*—Clifford D. Crowder
*Assistant Examiner*—Gloria Hale
*Attorney, Agent, or Firm*—R. Craig Armstrong

[57] ABSTRACT

A shoulder pad assembly for contact sports such as hockey is described. Two separate shoulder assemblies, in the form of generally U-shaped shoulder bands, are each pivotally connected fore and aft to chest and back pieces. Preferably the pivotal connections are co-axial, so that there are just two pivot points, namely fore and aft pivot points centrally located on the chest and back pieces, thus generally defining a V-shape for the shoulder portions of the pad. Preferably, the flexibility is limited by the use of a pivot clip at each pivot point, the pivot clip having at least one post disposed from the pivot axis and projecting from the clip through an arcuate slot in each shoulder band, the arcuate slots being of finite length such that further pivoting is prevented once the post reaches an end of the slot.

18 Claims, 3 Drawing Sheets

SHOULDER PAD ASSEMBLY FOR CONTACT SPORTS

BACKGROUND OF THE INVENTION

1. Field of the Invention

This invention relates to shoulder pads for use as protective gear in contact sports, especially hockey.

For convenience, reference will be made to hockey in particular throughout this description, but it should be clearly understood that that is by no means intended to be limiting. The principle of the invention may also be employed in football, or in any other contact sport where shoulder protection is required or desired.

2. Description of the Prior Art

In hockey, shoulder pads in the prior art have generally have limited flexibility, most commonly comprising a vest-like structure, or separate chest and back pieces, with shoulder and upper arm protective pads attached thereto.

Generally, when a player lifts one shoulder, the entire shoulder pad assembly shifts, including the vest structure, or chest and back pieces, and the opposite shoulder protection. The need to so displace the entire assembly necessarily means that more force is required than would otherwise be the case. It follows that the player's movement is more restricted than would otherwise be the case; the player has to exert more force to move, since he is forced to displace the entire assembly.

Furthermore, because the entire assembly has to shift, the pads tend to "ride up", thus potentially exposing portions of the upper body to injury.

SUMMARY OF THE INVENTION

It is an object of the invention to provide a shoulder pad assembly which overcomes the above deficiencies in the prior art shoulder pads, by facilitating independent movement of the shoulders.

In the invention, therefore, there are two separate shoulder assemblies, in the form of generally U-shaped shoulder bands each pivotally connected fore and aft, about a fore and aft axis or axes, to the vest structure or to separate chest and back pieces. These pivotal connections allow for greatly improved freedom of arm movement, while delivering superior protection and excellent coverage of the vital shoulder, clavicle, rib and sternum areas. Because each shoulder can move independently, the tendency of the pads to ride up is greatly reduced, thus enhancing safety.

Although the pivotal connections could be spaced apart laterally, preferably they are co-axial, so that there are just two pivot points, namely fore and aft pivot points centrally located on the chest and back pieces respectively, thus generally defining a V-shape for the shoulder portions of the pad.

In the preferred embodiment, the degree of flexibility is limited by the use of a novel pivot clip at each pivot point, which permits only a limited degree of pivoting. The pivot clip has at least one post or the like, positioned off the pivot axis and projecting from the clip through an arcuate slot in each shoulder band, the arcuate slots being of finite length such that further pivoting is prevented once the post reaches an end of the slot. At one extreme, this prevents the pad from collapsing inwardly should the player be "sandwiched", i.e. hit from both sides at once, and at the other extreme it prevents the pad from falling off the shoulders.

Although the invention is specifically designed for hockey, it should be apparent that the principle of the invention could be readily adapted to shoulder pads for other sports such as football.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
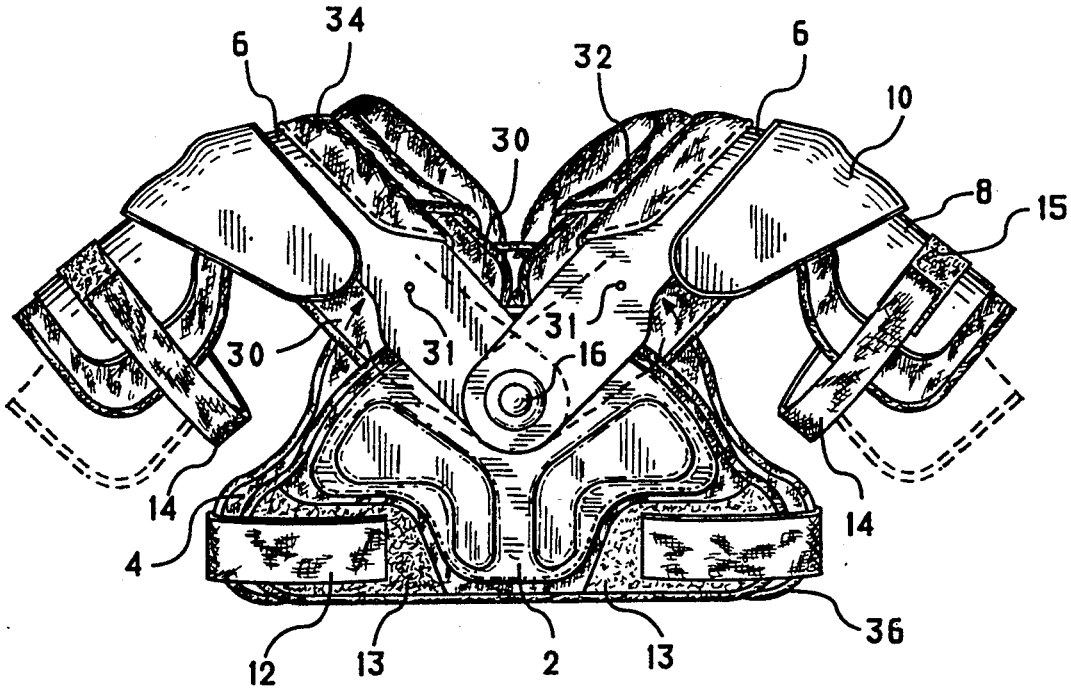
FIG. 1 is a front view of the preferred embodiment.
Figure 2:
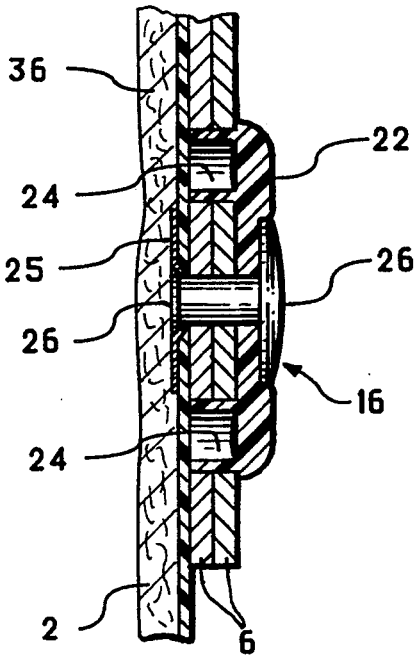
FIG. 2 is a cross-section of the pivot clip.
Figure 3:
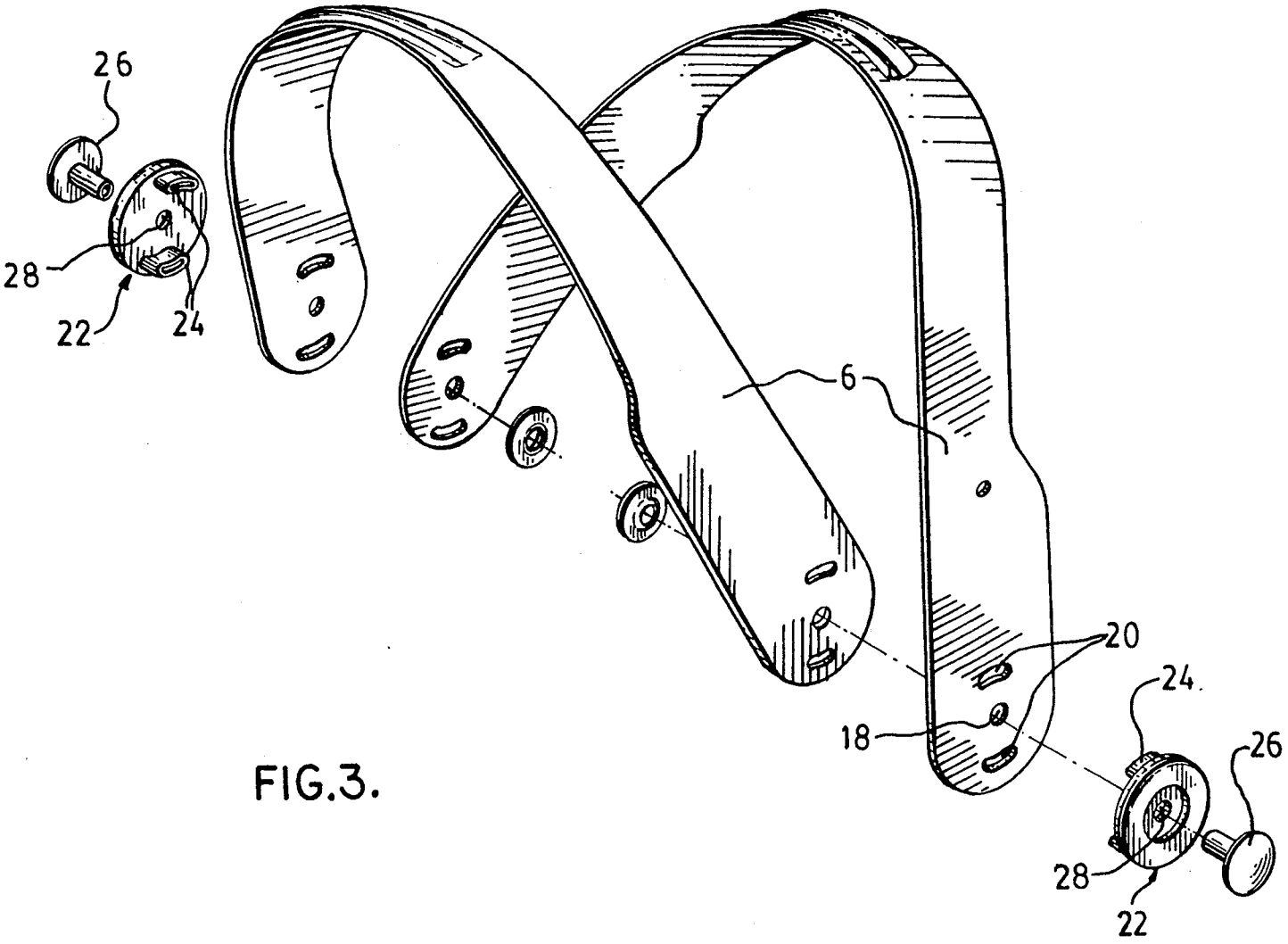
FIG. 3 is an exploded perspective view of the shoulder bands and pivot clips.

The main components of the pad assembly are a chest piece 2, a back piece 4, and two shoulder bands 6 connecting the chest and back pieces. Upper arm or bicep protectors 8 extend down from the shoulder area on each side, and are overlaid by polyethylene shoulder caps 10. The components are conventionally padded, as described in greater detail below.

Elastic straps 12 are sewn to the back piece, and are passable under the player's arms for securing to the chest piece by any suitable securing means, such as VELCRO (trademark) hook and pile fastening material, with the straps having hook material thereon and a portion 13 of the chest piece having pile material thereon. Similar elastic straps 14 are passable around the player's arms to secure the upper arm or bicep protectors, with hook material on the straps to engage pile material 15 on the bicep protectors.

Figure 4:
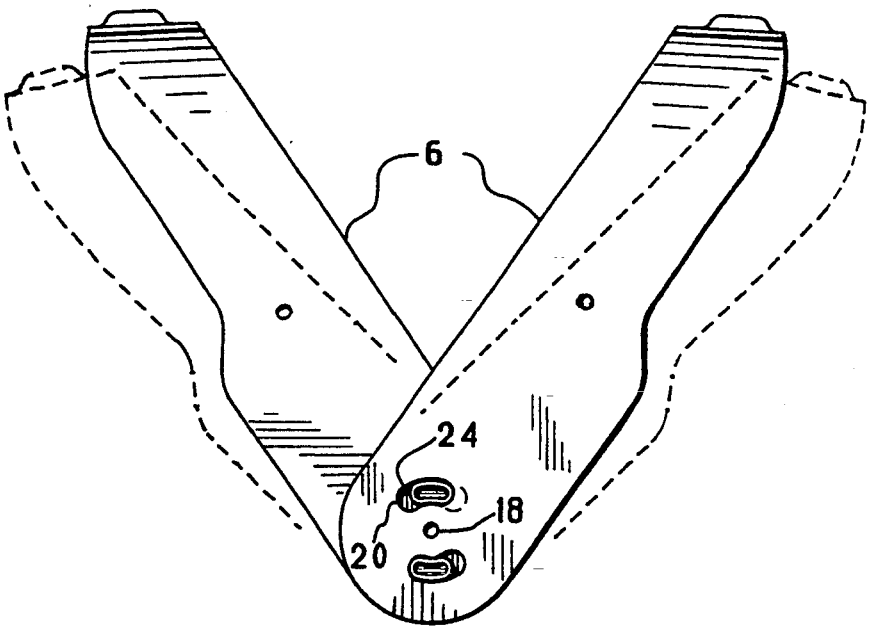
FIGS. 4 and 5 are front views of the shoulder bands, illustrating the flexing action.
Figure 5:
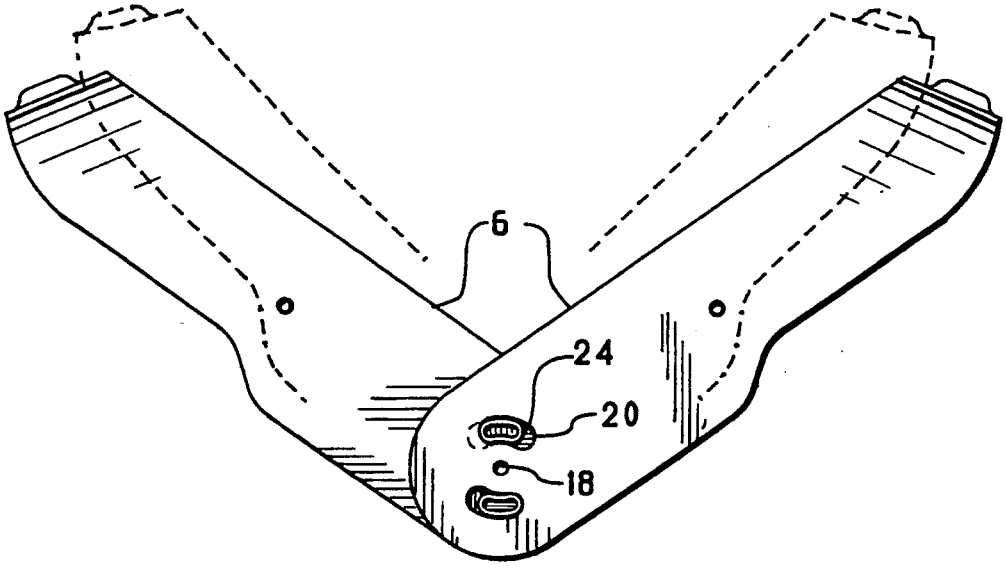

Each shoulder band 6 is of polyethylene approximately 3 mm thick. The key to the invention is that the shoulder bands are pivotally connected to the chest and back pieces, preferably at central, co-axial front and rear pivot points 16. At each pivot point location, each shoulder band has a central hole 18 and at least one and preferably two elongated arcuate slots 20. A pivot clip 22 is installed via a large rivet 26 passing through the central hole 18 and a central hole 28 in the pivot clip, the inner end of the rivet being flattened against a washer 25 to hold the rivet in place. The pivot clip should be free to rotate relative to the chest and back pieces, and has one or two posts, which could be cylindrical but preferably are in the form of arcuate projections 24, projecting approximately 6 mm (i.e. twice the thickness of the shoulder bands). The arcuate projections 24 ride in the arcuate slots 20, but are shorter than the slots. As seen best in FIGS. 4 and 5, this permits the bands to rotate with respect to each other to a limited degree, e.g. through about a 75 degree range, from about 45 degrees of separation to about 120 degrees of separation. The degree of permissible rotation obviously is variable simply by varying the relative dimensions of the arcuate slots and projections. The angles of separation are variable as desired simply by varying the orientation of the slots on the shoulder bands.

Padding 30 is positioned under the shoulder bands 6, held in place by rivets 31 in the front and corresponding rivets (not shown) in the back. A padded collar 32 is sewn to the padding 30. Additional collar padding 34 is secured to the shoulder bands themselves. Padding 36 is secured to the inside of the chest piece 2, and similar padding (not shown) is secured to the inside of the back piece 4.

It will be appreciated that the above description relates to the preferred embodiment by way of example only. Many variations on the invention will be obvious to those knowledgeable in the field, and such obvious variations are within the scope of the invention as described and claimed whether or not expressly described.

What is claimed as the invention is:

1. A shoulder pad assembly, comprising:

a generally planar chest piece;

a generally planar back piece, said chest and back pieces being generally parallel to, facing, and spaced from each other;

two generally U-shaped shoulder bands each having two ends, one said end being pivotally connected to said chest piece and the other said end being pivotally connected to said back piece;

padding means secured to each of said chest piece, said back piece, and said two shoulder bands; and means for securing said shoulder pad assembly around the upper body of a player, with said chest piece against the player's chest, said back piece against the player's back, and said shoulder band passing one over each shoulder area;

wherein said pivotal connections between said shoulder bands and said chest and back pieces are generally coaxial, and are centered laterally on said chest and back pieces.

2. A shoulder pad assembly as recited in claim 1, further comprising upper arm protectors flexibility fastened to said shoulder bands and extending outwardly and downwardly therefrom, overlaid by plastic shoulder caps also flexibly fastened to said shoulder bands.

3. A shoulder pad assembly as recited in claim 1, in which said pivotal connections permit pivoting of said shoulder bands only through a certain range of angles relative to each other.

4. A shoulder pad assembly as recited in claim 3, further comprising upper arm protectors flexibly fastened to said shoulder bands and extending outwardly and downwardly therefrom, overlaid by plastic shoulder caps also flexibly fastened to said shoulder bands.

5. A shoulder pad assembly as recited in claim 3, where each said pivotal connection comprises a pivot clip mounted at said pivot point, said pivot clip having at least one post disposed from said pivot axis, each said post projecting from said clip through an arcuate slot in each shoulder band, said arcuate-slots being of finite length such that further pivoting is prevented once said post reaches an end of said slot.

6. A shoulder pad assembly as recited in claim 5, in which there are two said posts on each pivot clip, each said post being in the form of an arcuate projection corresponding in radial position and dimensions to the radial position and dimensions of said arcuate slots.

7. A shoulder pad assembly as recited in claim 5, where said pivot clips are themselves pivotally mounted with respect to said chest and back pieces.

8. A shoulder pad assembly as recited in claim 6, where said pivot clips are themselves pivotally mounted with respect to said chest and back pieces.

9. A shoulder pad assembly as recited in claim 3, in which said range of angles, as defined by the angle between said shoulder bands, is between a minimum angle of about 45 degrees and a maximum angle of about 120 degrees.

10. A shoulder pad assembly as recited in claim 9, where each said pivotal connection comprises a pivot clip mounted at said pivot point, said pivot clip having at least one post disposed from said pivot axis, each said post projecting from said clip through an arcuate slot in each shoulder band, said arcuate slots being of finite length such that further pivoting is prevented once said post reaches an end of said slot.

11. A shoulder pad assembly as recited in claim 10, in which there are two said posts on each pivot clip, each said post being in the form of an arcuate projection corresponding in radial position and dimensions to the radial position and dimensions of said arcuate slots.

12. A shoulder pad assembly as recited in claim 10, where said pivot clips are themselves pivotally mounted with respect to said chest and back pieces.

13. A shoulder pad assembly as recited in claim 11, where said pivot clips are themselves pivotally mounted with respect to said chest and back pieces.

14. A shoulder pad assembly, comprising:

a generally planar chest piece;

a generally planar back piece, said chest and back pieces being generally parallel to, facing, and spaced from each other;

two generally U-shaped shoulder bands each having two ends, one said end being pivotally connected to said chest piece and the other said end being pivotally connected to said back piece, via pivotal connections which permit pivoting only through a certain range of angles;

padding means secured to each of said chest piece, said back piece, and said two shoulder bands; and means for securing said shoulder pad assembly around the upper body of a player, with said chest piece against the player's chest, slid back piece against the player's back, and said shoulder bands passing one over each shoulder area;

where each said pivotal connection comprises a pivot clip mounted at said pivot point, said pivot clip having at least one post disposed from said pivot axis, each said post projecting from said clip through an arcuate slot in each shoulder band, said arcuate slots being of finite length such that further pivoting is prevented once said post reaches an end of said slot.

15. A shoulder pad assembly as recited in claim 14, in which there are two said posts on each pivot clip, each said post being in the form of an arcuate projection corresponding in radial position and dimensions to the radial position and dimensions of said arcuate slots.

16. A shoulder pad assembly as recited in claim 15, where said pivot clips are themselves pivotally mounted with respect to said chest and back pieces.

17. A shoulder pad assembly as recited in claim 14, where said pivot clips are themselves pivotally mounted with respect to said chest and back pieces.

18. A shoulder pad assembly comprising:

a generally planar chest piece;

a generally planar back piece, said chest and back pieces being generally parallel to, facing, and spaced from each other;

two generally U-shaped shoulder bands each having two ends, one said end being pivotally connected to said chest piece and the other said end being pivotally connected to said back piece;

padding means secured to each of said chest piece, said back piece, and said two shoulder bands; and means for securing said shoulder pad assembly around the upper body of player, with said chest piece against the player's chest, said back piece against the player's back, and said shoulder bands passing one over each shoulder area;

further comprising upper arm protectors flexibly fastened to said shoulder bands and extending outwardly and downwardly therefrom, overlaid by plastic shoulder caps also flexibly fastened to said shoulder bands.

* * * * *